US006328224B1

(12) United States Patent
Alexander

(10) Patent No.: US 6,328,224 B1
(45) Date of Patent: Dec. 11, 2001

(54) REPLACEABLE LINER FOR POWDER COATING APPARATUS

(75) Inventor: Kevin L. Alexander, Brownsburg, IN (US)

(73) Assignee: Illinois Tool Works Inc., Glenview, IL (US)

( * ) Notice: Subject to any disclaimer, the term of this patent is extended or adjusted under 35 U.S.C. 154(b) by 430 days.

(21) Appl. No.: 08/794,869

(22) Filed: Feb. 5, 1997

(51) Int. Cl.[7] ..... B05B 3/10; B05B 1/00

(52) U.S. Cl. ..... 239/223; 239/224; 239/591; 239/700; 239/703; 239/704; 239/708

(58) Field of Search ..... 239/223, 224, 239/591, 700, 701, 703, 704, 708

(56) References Cited

U.S. PATENT DOCUMENTS

| | | | | |
|---|---|---|---|---|
| 2,690,901 | * | 10/1954 | McCormack | 239/591 X |
| 2,989,241 | * | 6/1961 | Badger | 239/703 |
| 3,111,179 | * | 11/1963 | Albers et al. | 239/591 |
| 3,263,127 | | 7/1966 | Point et al. . | |
| 3,536,514 | | 10/1970 | LaFave et al. . | |
| 3,870,232 | | 3/1975 | Lacchia . | |
| 4,024,815 | | 5/1977 | Platsch . | |
| 4,037,561 | | 7/1977 | LaFave et al. . | |
| 4,114,564 | | 9/1978 | Probst . | |
| 4,116,384 | | 9/1978 | Lacchia . | |
| 4,232,832 | | 11/1980 | De Fusco . | |
| 4,235,381 | | 11/1980 | Vila . | |
| 4,381,079 | | 4/1983 | Allen . | |
| 4,447,008 | | 5/1984 | Allen . | |
| 4,788,933 | | 12/1988 | Buschor . | |
| 4,815,241 | * | 3/1989 | Woodson | 239/591 X |
| 4,993,645 | | 2/1991 | Buschor . | |
| 5,022,590 | | 6/1991 | Buschor . | |
| 5,240,185 | | 8/1993 | Kaiju et al. . | |
| 5,323,547 | | 6/1994 | Kaiju et al. . | |
| 5,335,828 | | 8/1994 | Kaiju et al. . | |
| 5,353,995 | | 10/1994 | Chabert . | |
| 5,443,387 | | 8/1995 | Howe et al. . | |
| 5,632,448 | | 5/1997 | Alexander et al. | 239/703 |
| 5,633,306 | | 5/1997 | Howe et al. | 239/700 X |
| 5,634,598 | * | 6/1997 | Colavito et al. | 239/591 |
| 5,662,278 | * | 9/1997 | Howe et al. | 239/700 |

FOREIGN PATENT DOCUMENTS

| | | | | |
|---|---|---|---|---|
| 670138 | * | 5/1989 | (CH) | 239/591 |
| 24 46 022 | | 4/1976 | (DE) . | |
| 28 37 428 | | 3/1979 | (DE) . | |
| 467634 | * | 1/1992 | (EP) | 239/591 |
| 2 605 533 | | 4/1988 | (FR) . | |

OTHER PUBLICATIONS

Aerobell™ Powder Applicator ITW Automatic Division.
Aerobell™ & Aerobell Plus™ Rotary Atomizer, DeVilbiss Ransburg Industrial Liquid Systems.

* cited by examiner

*Primary Examiner*—David A. Scherbel
*Assistant Examiner*—Robin O. Evans
(74) *Attorney, Agent, or Firm*—Barnes & Thornburg

(57) ABSTRACT

A dispensing device for powder coating material includes an outer device portion having a first inner surface and a central passageway for mounting the outer portion on a rotary shaft for rotating the dispensing device. An inner portion of the dispensing device has a second outer surface shaped complementarily to the first surface and a somewhat bell- or cup-shaped third inner surface. Threaded fasteners retain the inner portion in the outer portion with the first and second surfaces in engagement. The outer portion is constructed from a first material having mechanical strength to withstand the stresses attending rotation of the dispensing device. The inner portion is constructed from a second material relatively more inert to the movement of the powder coating material across the third surface.

6 Claims, 10 Drawing Sheets

REPLACEABLE LINER FOR POWDER COATING APPARATUS

BACKGROUND OF THE INVENTION

This invention relates to rotary coating material dispensers. It is disclosed in the context of a rotary dispenser for a stream of fluidized powder coating material. However, it is believed to have utility in other applications as well.

Various types and configurations of rotary coating material dispensers are known. There are, for example, the rotary coating material dispensers illustrated and described in U.S. Pat. Nos. 3,536,514; 4,037,561; 4,114,564; 4,381,079; 4,447,008; 5,353,995; and, 5,433,387; "Aerobell™ Powder Applicator ITW Automatic Division," and, "Aerobell™ & Aerobell Plush™ Rotary Atomizer, DeVilbiss Ransburg Industrial Liquid Systems." No representation is intended that a complete search has been made of the prior art, or that no better art references than those listed are available.

SUMMARY OF THE INVENTION

According to the invention, a dispensing device for a coating material includes an outer portion including a first, inner surface. The outer portion has a central passageway for mounting the outer portion on a rotary shaft for rotating the dispensing device. The dispensing device further includes an inner portion having a second, outer surface shaped complementarily to the first surface and a somewhat bell- or cup-shaped third, inner surface. Means are provided for retaining the inner portion in the outer portion with the first and second surfaces in engagement.

Illustratively, the outer portion is constructed from a first material having mechanical strength to withstand the stresses attending rotation of the dispensing device but being relatively less inert to the movement of coating material across it. The inner portion is constructed from a second material relatively more inert to the movement of coating material across the third surface.

Additionally illustratively, the first and second portions both extend to a circular discharge edge of the dispensing device.

Further illustratively, the apparatus comprises a third portion having a fourth surface cooperating with the circular discharge edge to define an annular discharge slot.

Additionally illustratively, the third portion is constructed from the second material.

Further illustratively, the means for retaining the inner portion in the outer portion comprises means for retaining the third portion in spaced apart relation to the second portion to define the annular discharge slot.

BRIEF DESCRIPTION OF THE DRAWINGS

The invention may best be understood by referring to the following detailed description and accompanying drawings which illustrate the invention. In the drawings.

DETAILED DESCRIPTION OF AN ILLUSTRATIVE EMBODIMENT

Figure 1:
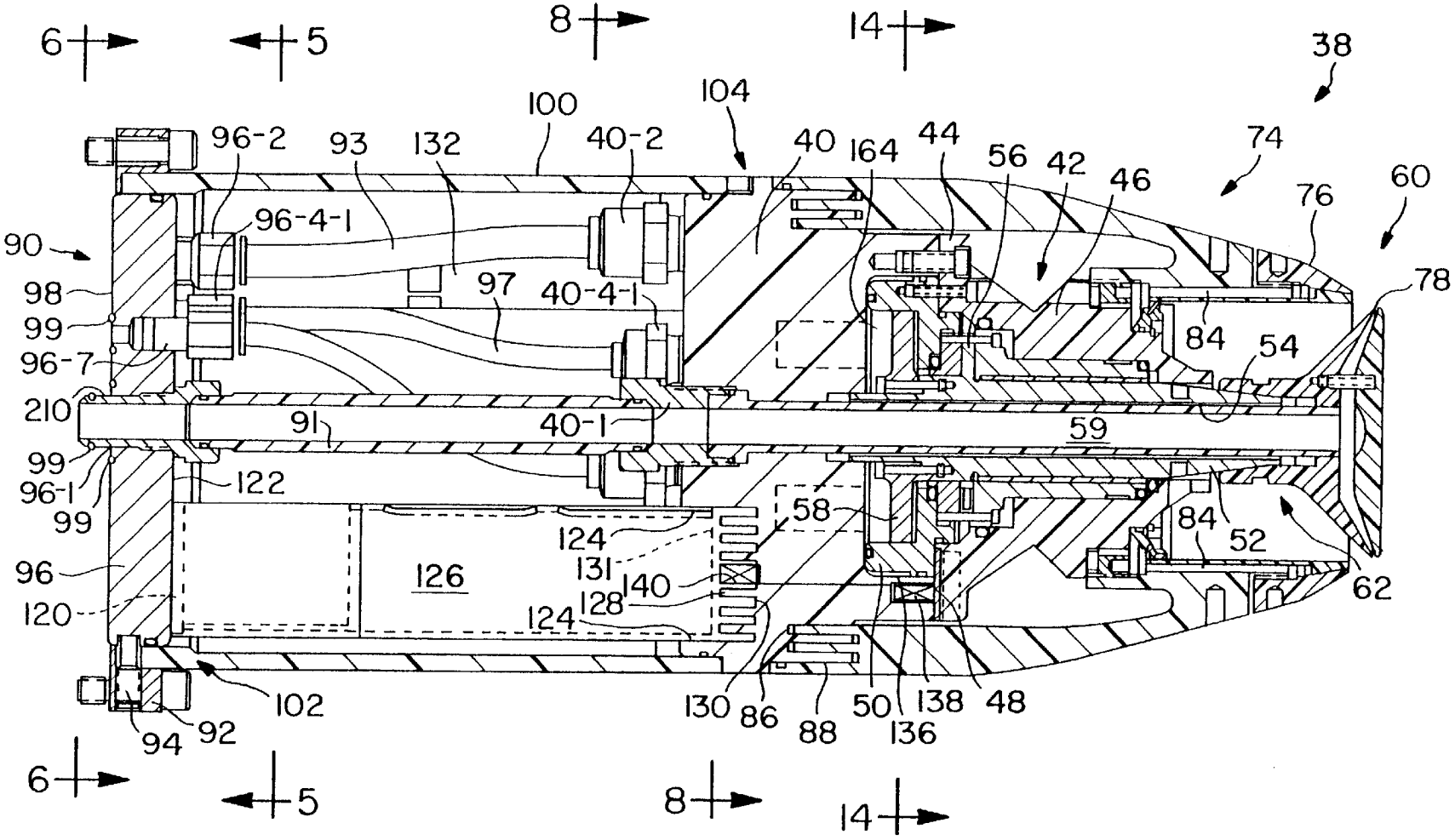
FIG. 1 illustrates a longitudinal sectional view through a powder dispenser embodying the present invention.
Figure 2:
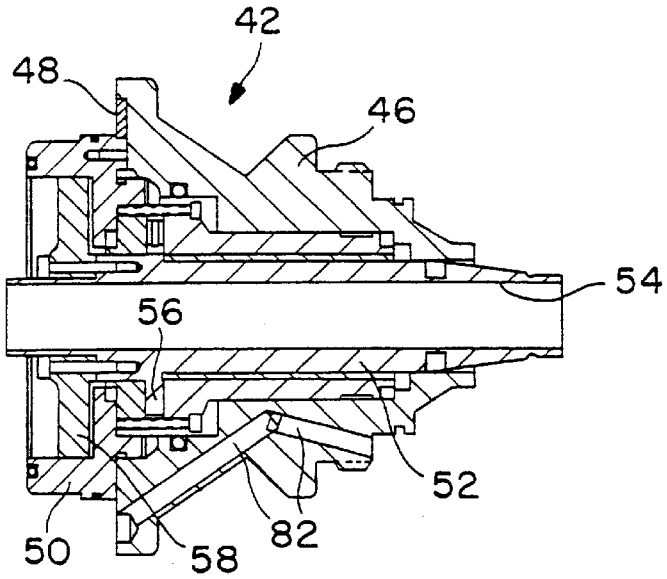
FIG. 2 illustrates another longitudinal sectional view through a detail of the powder dispenser illustrated in FIG. 1.
Figure 3:
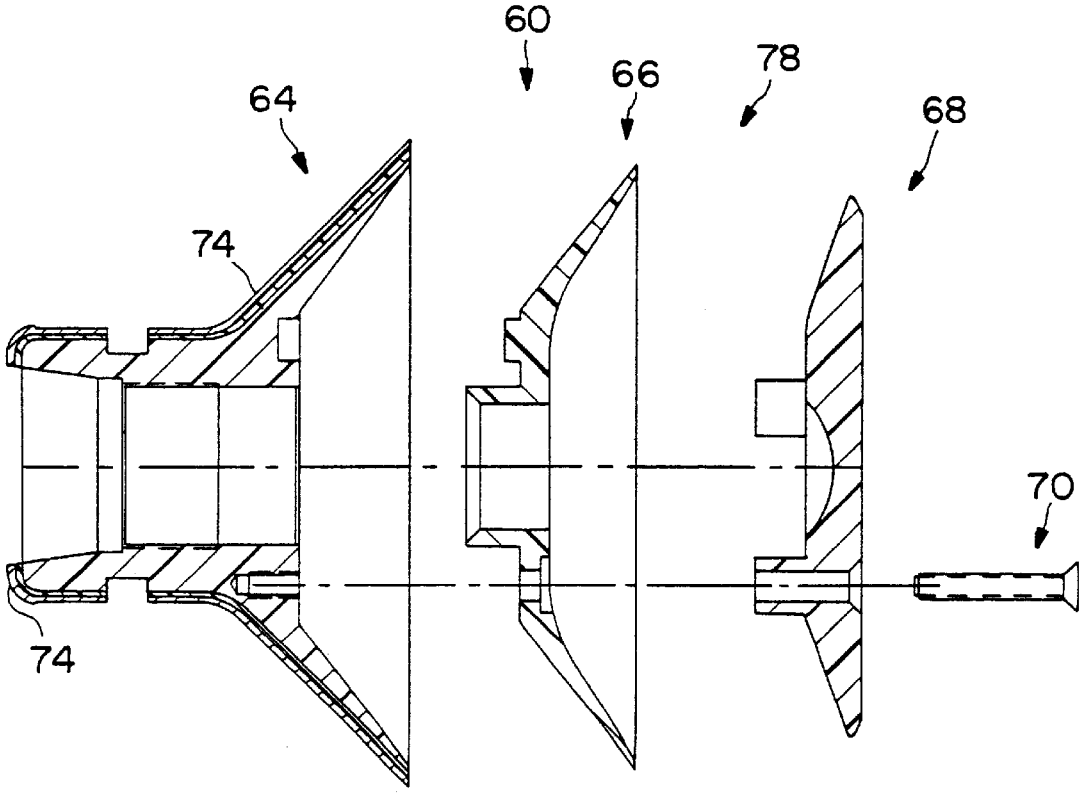
FIG. 3 illustrates an exploded longitudinal sectional view through a detail of the powder dispenser illustrated in FIG. 1.
Figure 4:
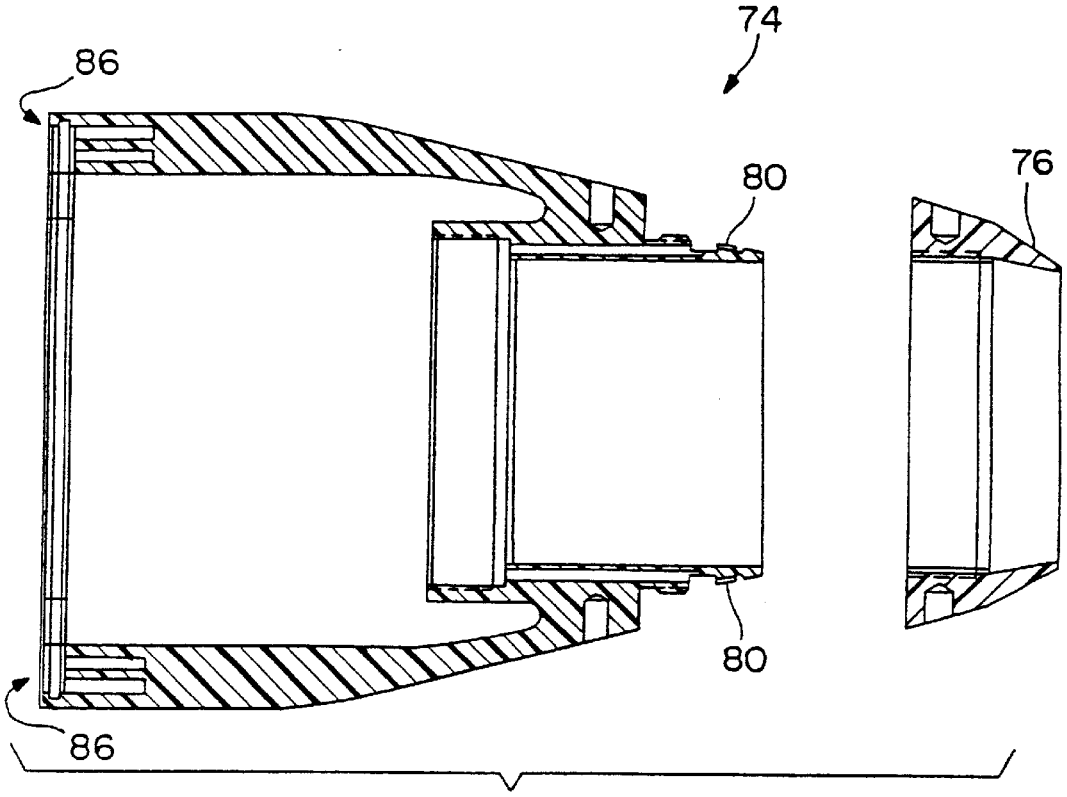
FIG. 4 illustrates an exploded longitudinal sectional view through a detail of the powder dispenser illustrated in FIG. 1.
Figure 4A:
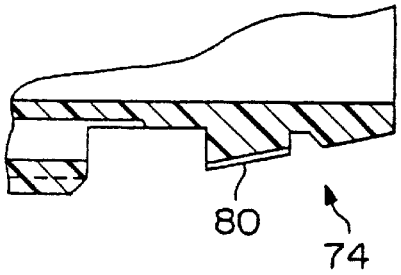
FIG. 4*a* illustrates an enlarged fragmentary view of a detail of FIG. 4.
Figure 5:
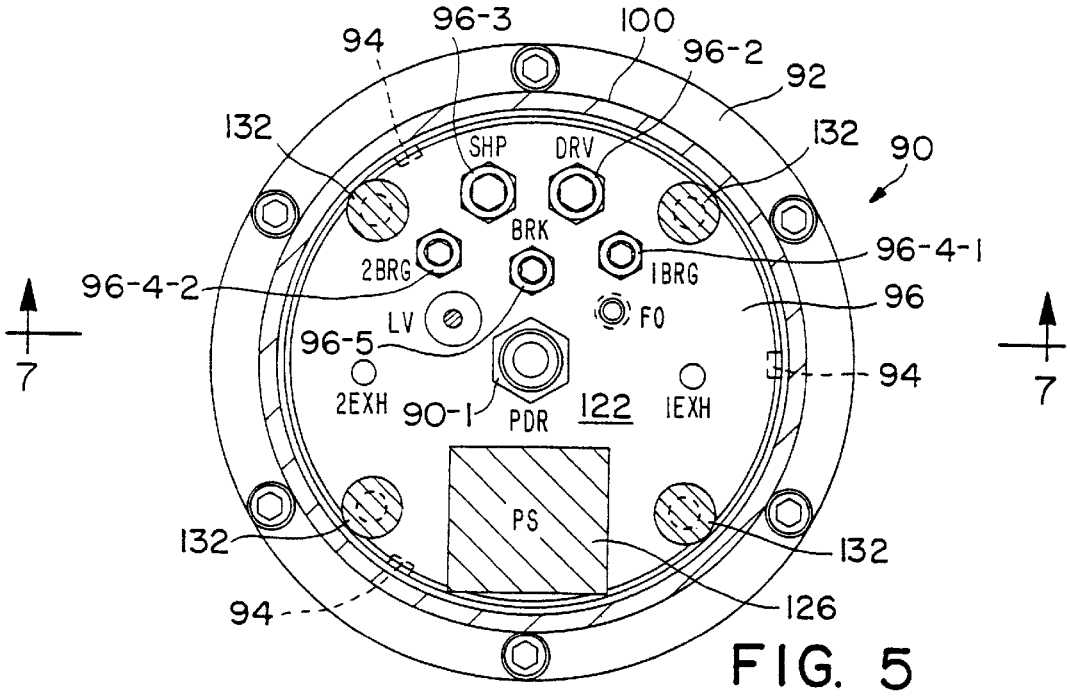
FIG. 5 illustrates a sectional view through the powder dispenser illustrated in FIG. 1, taken generally along section lines 5—5 of FIG. 1.
Figure 6:
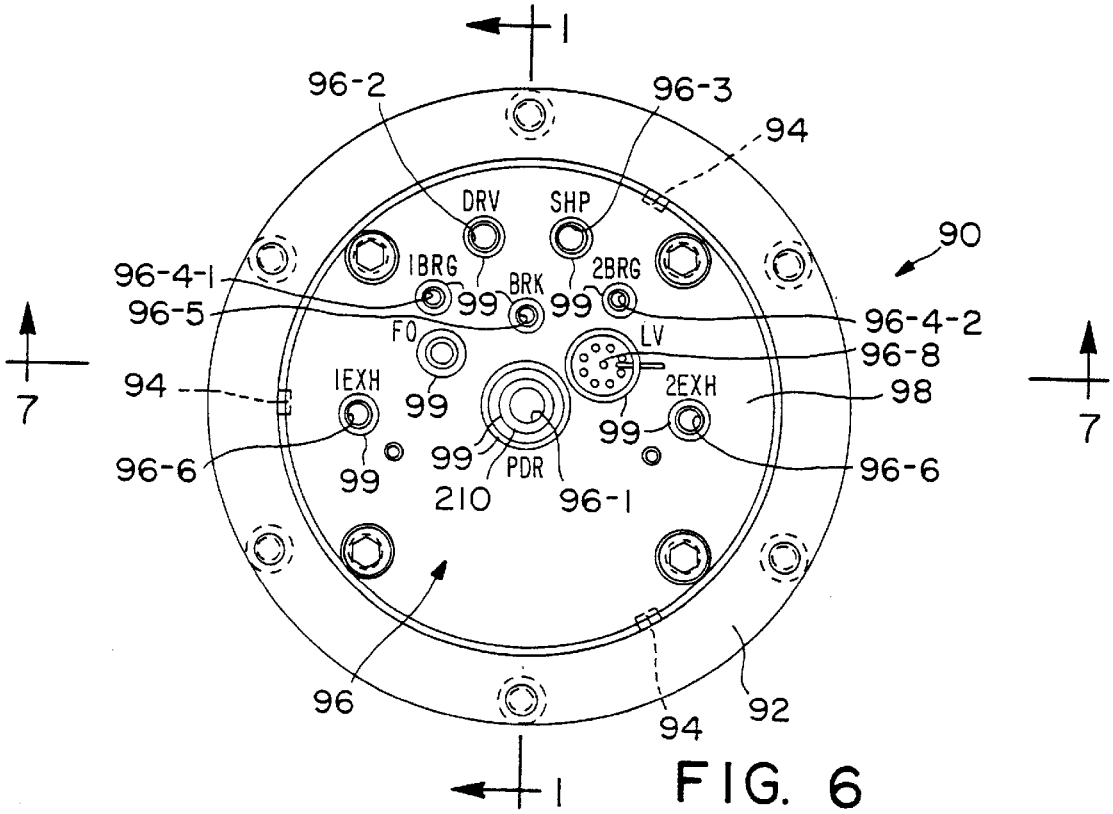
FIG. 6 illustrates a view of the powder dispenser illustrated in FIG. 1, taken generally along section lines 6—6 of FIG. 1.
Figure 7:
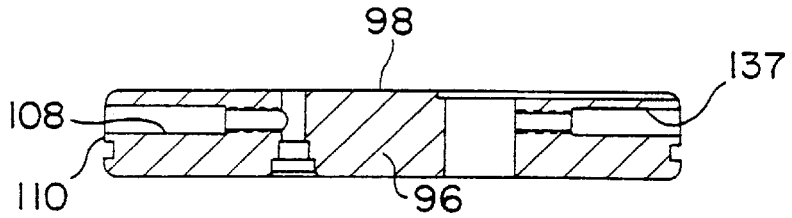
FIG. 7 illustrates a sectional view through a detail of the powder dispenser illustrated in FIG. 1, taken generally along section lines 7—7 of FIGS. 5–6.
Figure 8:
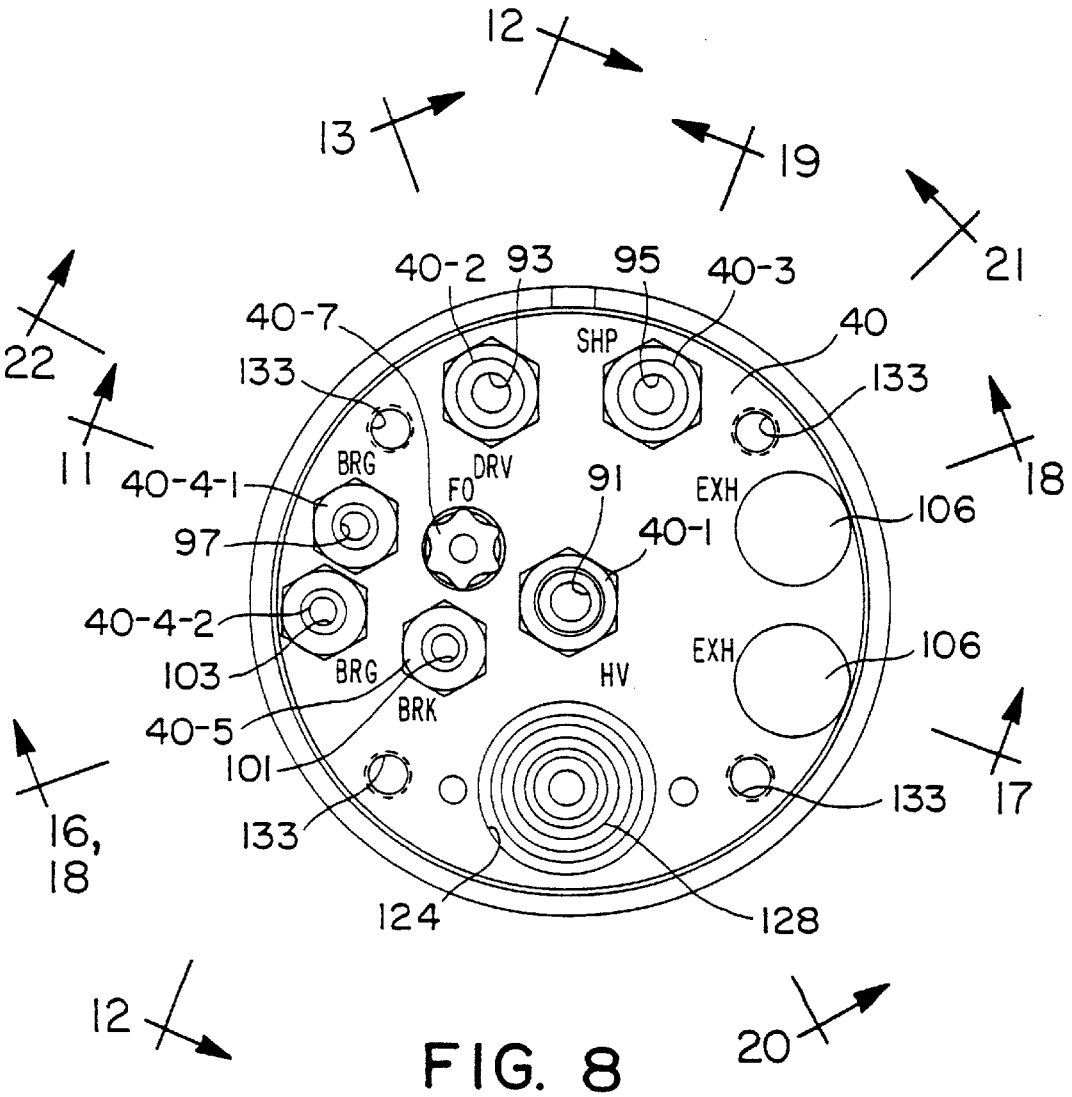
FIG. 8 illustrates a sectional view through the powder dispenser illustrated in FIG. 1, taken generally along section lines 8—8 of FIG. 1.
Figure 9:
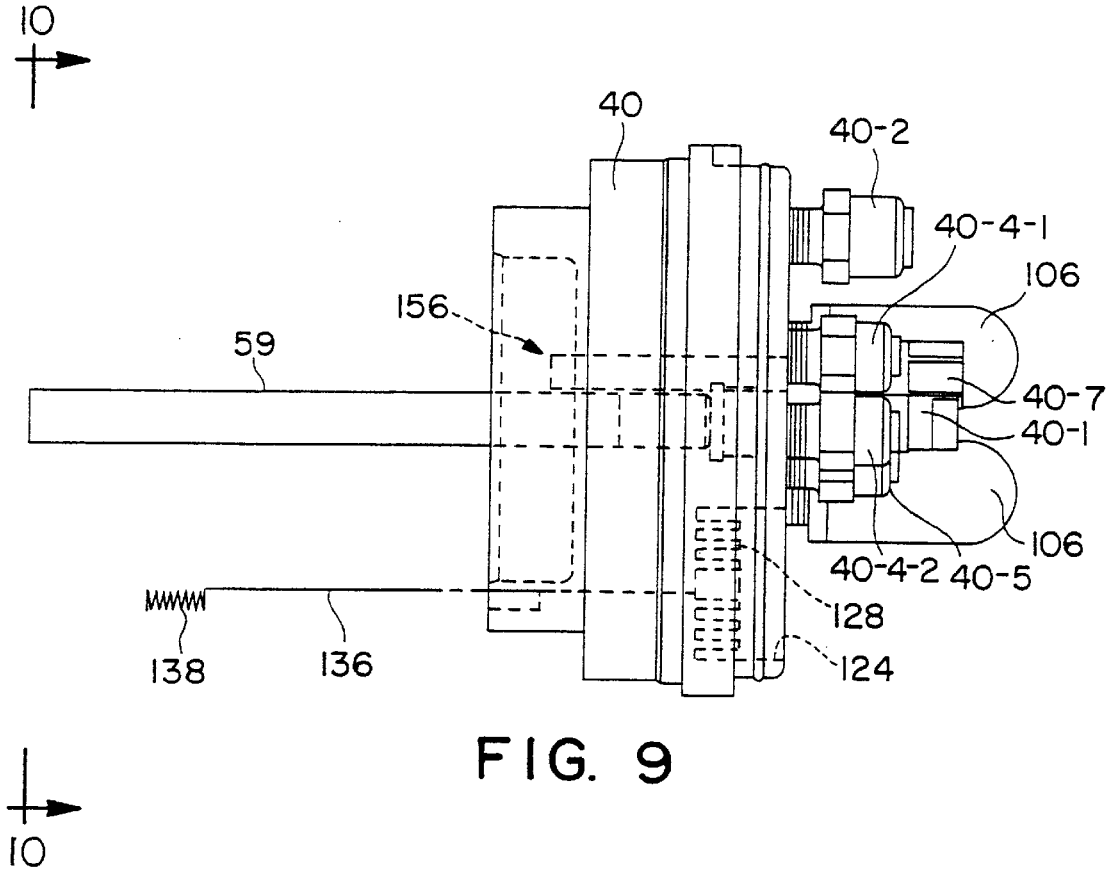
FIG. 9 illustrates a side elevational view of certain details of the powder dispenser illustrated in FIG. 1.
Figure 10:
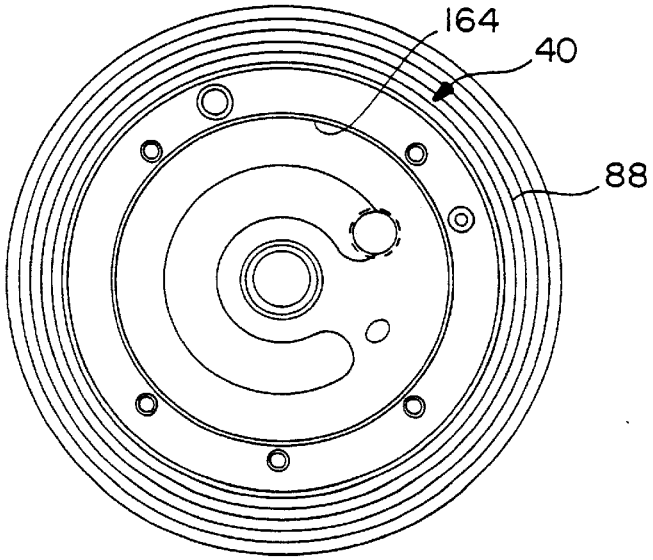
FIG. 10 illustrates a view of the details of the powder dispenser illustrated in FIG. 9, taken generally along section lines 10—10 of FIG. 9.
Figure 11:
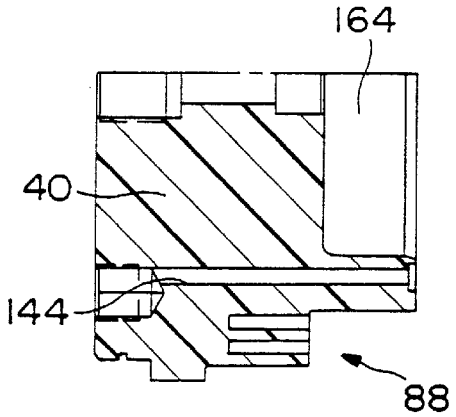
FIG. 11 illustrates a fragmentary sectional view through a detail of the powder dispenser illustrated in FIG. 1, taken generally along section line 11 and the axis of FIG. 8.
Figure 12:
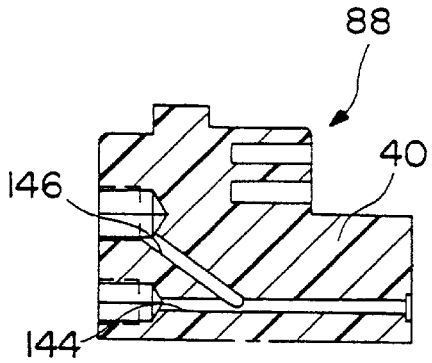
FIG. 12 illustrates a fragmentary sectional view through a detail of the powder dispenser illustrated in FIG. 1, taken generally along section line 12 and the axis of FIG. 8.
Figure 13:
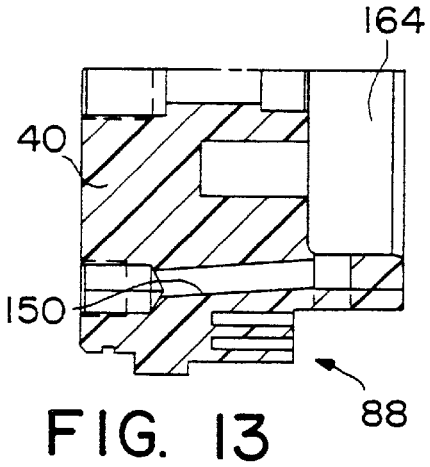
FIG. 13 illustrates a fragmentary sectional view through a detail of the powder dispenser illustrated in FIG. 1, taken generally along section line 13 and the axis of FIG. 8.
Figure 16:
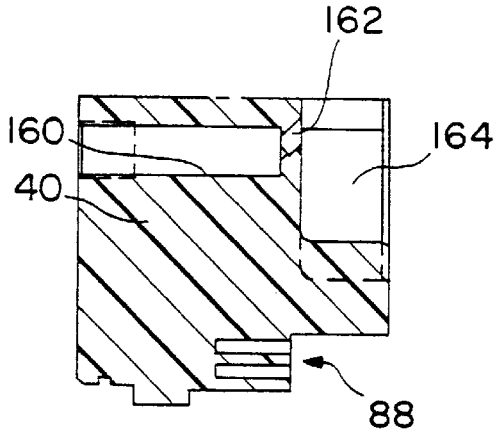
FIG. 16 illustrates a fragmentary sectional view through a detail of the powder dispenser illustrated in FIG. 1, taken generally along section line 16 and the axis of FIG. 8.
Figure 14:
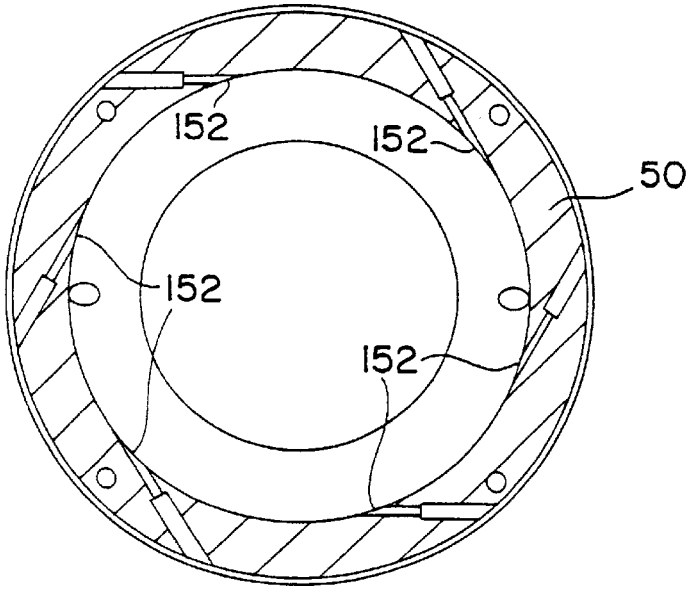
FIG. 14 illustrates a sectional view through a detail of the powder dispenser illustrated in FIG. 1, taken generally along section lines 14—14 of FIG. 1.
Figure 15:
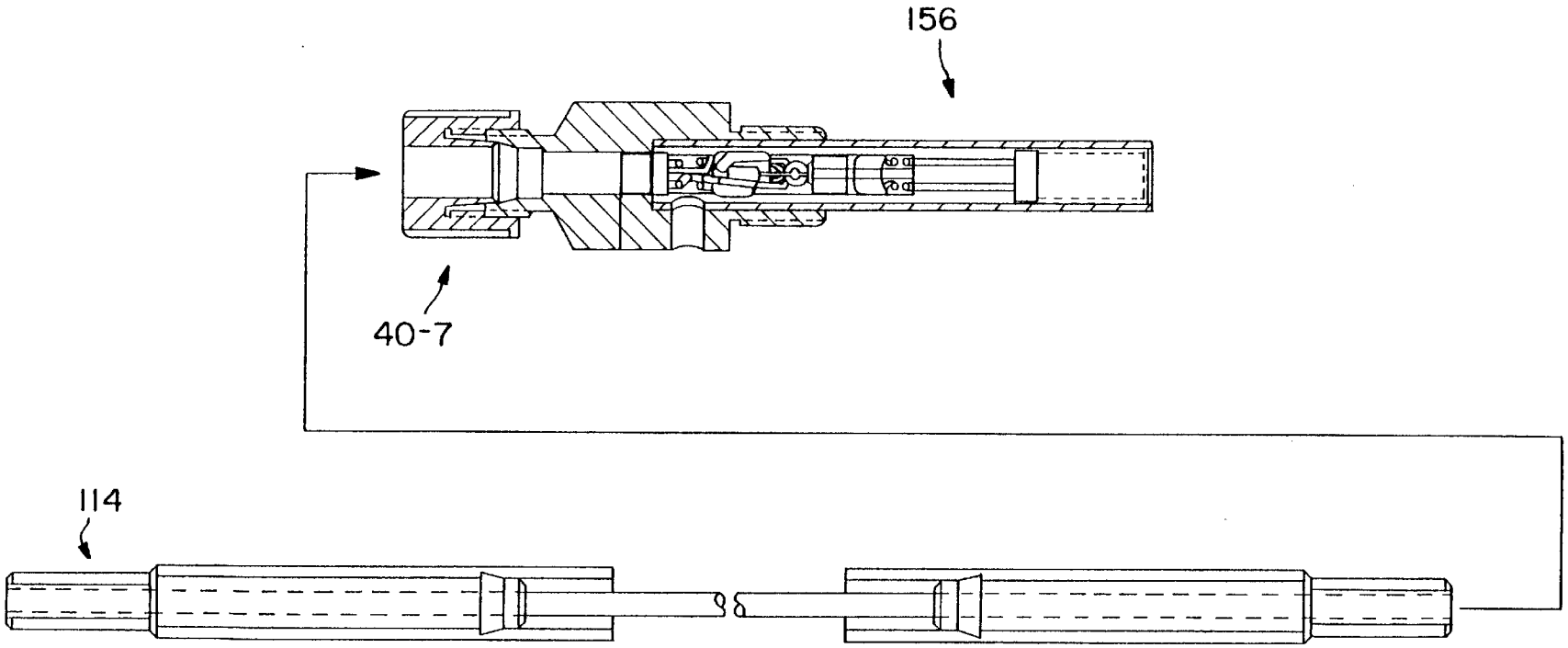
FIG. 15 illustrates a fragmentary, exploded, partial longitudinal sectional view of a detail of the powder dispenser illustrated in FIG. 1.
Figure 17:
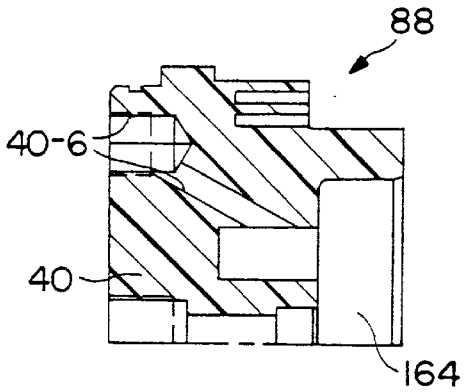
FIG. 17 illustrates a fragmentary sectional view through a detail of the powder dispenser illustrated in FIG. 1, taken generally along section line 17 and the axis of FIG. 8.
Figure 18:
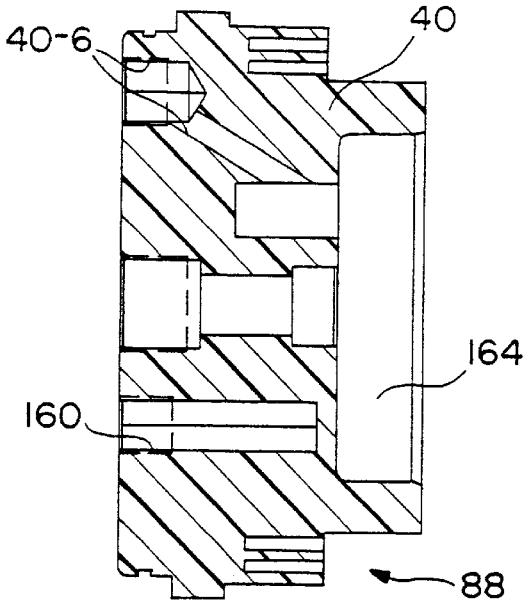
FIG. 18 illustrates a fragmentary sectional view through a detail of the powder dispenser illustrated in FIG. 1, taken generally along section lines 18—18 of FIG. 8.
Figure 19:
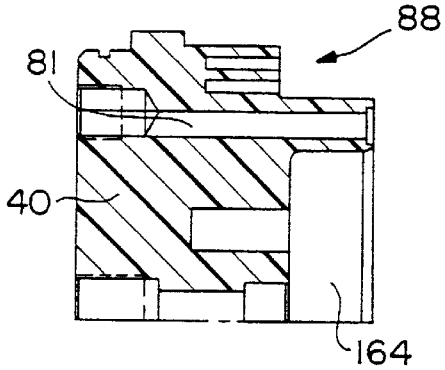
FIG. 19 illustrates a fragmentary sectional view through a detail of the powder dispenser illustrated in FIG. 1, taken generally along section line 19 and the axis of FIG. 8.
Figure 20:
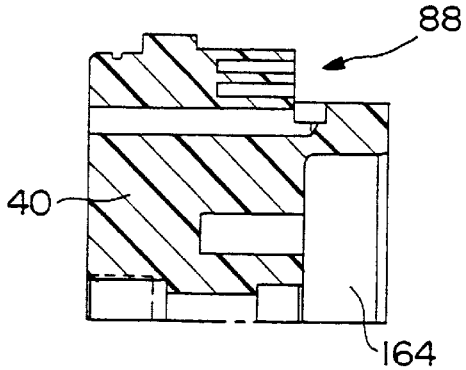
FIG. 20 illustrates a fragmentary sectional view through a detail of the powder dispenser illustrated in FIG. 1, taken generally along section line 20 and the axis of FIG. 8.
Figure 21:
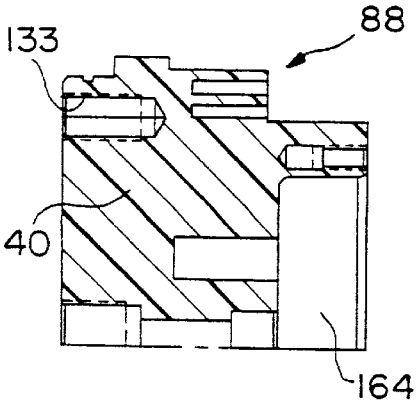
FIG. 21 illustrates a fragmentary sectional view through a detail of the powder dispenser illustrated in FIG. 1, taken generally along section line 21 and the axis of FIG. 8.
Figure 22:
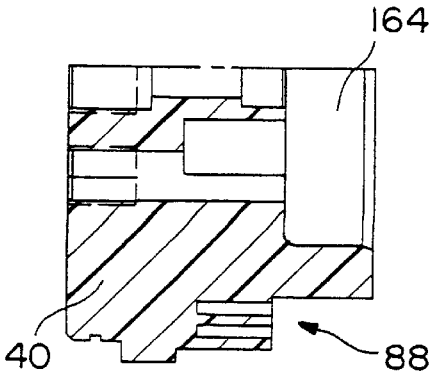
FIG. 22 illustrates a fragmentary sectional view through a detail of the powder dispenser illustrated in FIG. 1, taken generally along section line 22 and the axis of FIG. 8.

A rotary powder dispenser 38 according to the invention includes a manifold 40. Manifold 40 illustratively is constructed from, for example, Acetron® GP general purpose acetal available from DSM Engineering Plastic Products, Incorporated, Reading, Pa. 19612-4235. An air turbine motor assembly 42 is mounted from a front side 44 of manifold 40 and extends forward therefrom. Motor assembly 42 includes a turbine motor housing 46 constructed from, for example 150SA or 550SA Delrin® material, a high voltage contact plate 48 constructed from, for example, aluminum, a turbine air nozzle plate 50 constructed from, for example, aluminum, an air turbine shaft 52 having a central axial passageway 54 therethrough, a thrust bearing spacer 56 and a turbine rotor 58. The turbine motor assembly 42 can be, for example a part D1245-07 available from Westwind Air Bearings, Inc., 745 Phoenix Drive, Ann Arbor, Mich. 48108. A, for example, glass reinforced Delrin® feed tube 59 extends down the center of passageway 54.

A powder bell cup assembly 60 is threaded onto front end 62 of shaft 52. Powder bell cup assembly 60 includes a bell cup 64 constructed from, for example, filled or unfilled polyetheretherketone (PEEK), a bell cup insert or liner 66 constructed from, for example, Teflon® or Delrin® material, and a diffuser 68 also constructed from, for example, Teflon® or Delrin® material, all held together by three equally circumferentially spaced slotted flat head screws 70. Diffuser 68 illustratively is configured as illustrated and described in U.S. Ser. No. 08/377,816 filed Jan. 25, 1995, now U.S. Pat. No. 5,632,448 . The outer surfaces 74 of bell cup 64 are treated as described in U.S. Ser. No. 08/451,570 filed May 26, 1995, now U.S. Pat. No. 5,662,278, U.S. Ser. No. 08/437,218 filed May 8, 1995, now U.S. Pat. No. 5,633,306 and U.S. Ser. No. 08/451,541 filed May 26, 1995 now U.S. Pat. No. 5,622,563. These four applications are incorporated herein by reference. The material from which bell cup 64 is constructed accepts the above-identified treatment of its outside surfaces 74 well. The material from which the liner 66 is constructed has somewhat less susceptibility to impact fusion of many coating powders of the type being dispensed by dispenser 38.

A somewhat projectile-shaped front shroud 74 having a shaping air ring cap 76 houses the forward part of manifold 40, turbine motor assembly 42, and most of powder bell cup assembly 60 except the forwardmost portions thereof, including the powder discharge slot 78 defined between liner 66 and diffuser 68. Radially outwardly and axially extending ribs 80 provided on shroud 74 help define between shroud 74 and shaping air-ring cap 76 an annular shaping air slot which is provided with shaping air through passageways 81, 82, 84 provided in manifold 40, turbine housing 46, and front shroud 74, respectively. The complementary, mating surfaces 86, 88 of shroud 74 and manifold 40 are labyrinthine in configuration to provide longer pathways across the surfaces of these two components. This reduces the likelihood of tracking of the high magnitude electrical potential which is impressed upon, for example, high voltage contact plate 48 during operation of dispenser 38 back to, for example, grounded dispenser 38 support.

A rear manifold plate assembly 90 includes a rear manifold mounting flange 92 attached by three equally circumferentially spaced screws 94 to a rear manifold mounting plate 96. The rearward surface 98 of plate 96 is finished flat and smooth. A generally right circular cylindrical rear shroud 100 is captured at its rearward extent in an annular groove 102 provided by adjacent surfaces of plate 96 and flange 92 and at its forward extent in an annular groove 104 provided on the rearwardly facing side of manifold 40. Appropriate fittings and lines connect the respective fluidized PowDeR (fittings 96-1 and 40-1 and line 91), powder cloud SHaPing air (fittings 96-3 and 40-3 and line 95), turbine DRiVing air (fittings 96-2 and 40-2 and line 93), turbine BeaRinG air 1 and 2 (fittings 96-4-1, 96-4-2, 40-4-1 and 40-4-2 and lines 97 and 103) and turbine BRaKing air ports (fittings 96-5 and 40-5 and line 101) on plate 96 and manifold 40. Turbine air EXHaust ports 1 and 2 (ports 96-6) in plate 96 vent turbine exhaust air from within rear shroud 100. This air is exhausted from turbine 42 through mufflers 106 fitted to the two EXHaust ports (40-6) on manifold 40.

FiberOptic speed control fittings (40-7 and 96-7) are provided on both manifold 40 and plate 96. The FiberOptic speed control fitting 96-7 on plate 96 is intersected by a threaded bore 108 which extends into plate 96 from its edge 110. A cap screw is threaded into bore 108 to provide for the precise location of an optical fiber terminal 114 at the flat surface 98 of plate 96. This facilitates matching of the optical fiber terminal 114 to a lens mounted in a flat plate onto which plate 96 is mounted by bolts 116 for quick and easy replacement. This mechanism avoids the time consuming necessity of aligning terminal 114 with the lens if dispenser 38 should have to be removed for any reason including replacement by a similarly designed dispenser. The fluidized PowDeR (96-1), powder cloud SHaPing air (96-3), turbine DRiVing (air 96-2), turbine BeaRinG air (96-4-1 and 96-4-2) and turbine BRaKing air (96-5) ports on surface 98 are provided with surrounding 0-ring seals 99.

A generally right rectangular cylindrical boss 120 is provided on the forward or inside surface 122 of plate 96. A generally right circular cylindrical relief 124 is provided on the rearward surface of manifold 40 directly opposite boss 120. An ITW Ransburg MICRO-PAK™ high voltage transformer and cascade-type voltage multiplier 126 is captured between boss 120 and relief 124. The floor 128 of relief 124 is labyrinthine to complement the configuration of high magnitude potential output end 130 of high voltage multiplier 126. Again, this configuration provides longer pathways across the surfaces of multiplier 126 and manifold 40 from the high magnitude potential terminal 131 of multiplier 126 to ground. Manifold 40, turbine motor assembly 42 and front shroud 74 are supported from rear manifold plate 96 by four equally circumferentially spaced support rods 132 which have threaded ends for threading into complementarily threaded holes 133 provides therefor in manifold 40. Support rods 132 are attached to plate 96 by cap screws 135.

Bearing air is supplied to the turbine 42 air bearing through the 1 BRG port. The 2 BRG port couples the air bearing to a pressure sensing switch, not shown. If the switch senses the loss of pressure in the air bearing, the flows of fluidized powder coating material and driving air are halted and the turbine 42 is permitted to coast to a stop in an effort to save the turbine 42.

Low alternating current voltage, for example 12 VAC–30 VAC, is supplied through the LowVoltage connector 96-8 on plate 96 to the low voltage terminals of multiplier 126. LowVoltage connector 96-8 is also held in place by a cap screw (not shown) threaded into a bore 137 in the edge 110 of plate 96. Bore 137 intersects the bore into which connector 96-8 is fitted. A, for example, phosphor bronze, wire 136 has several coils of compression spring 138 formed at one end thereof. The end 140 of wire 136 opposite spring 138 fits into the cavity in multiplier 126 in which terminal 131 is provided. The spring 138 is compressed in contact with high voltage contact plate 48 during assembly of turbine 42 to manifold 40.

BeaRinG air for turbine 42 is supplied from fitting 40-4-1 through passageways 144 to the air bearing 145 of turbine 42. This bearing air is sensed through passageways 146 by the above mentioned air BeaRinG pressure sensing switch connected to fitting 40-4-2. If BeaRinG air pressure is present at fitting 40-4-2, DRiVing air for turbine 42 flows forward through fitting 40-2 and passageways 150 from which it flows through the turbine 42 nozzles 152 and against the blades of the turbine rotor 58 to rotate rotor 58 and the powder bell cup assembly 60 mounted on the end 62 of shaft 52.

Turbine 42 rotation rate signals are coupled back through, for example, a DeVilbiss Ransburg model LSMC 5003 inductive-to-fiber optic signal transmitter 156 which generates a pulse of light each time it senses the passage of a small magnetic disk (not shown) mounted in the rearwardly facing surface of rotor 58 facing transmitter 156. This signal is transmitted through fiber optic coupler 114 to surface 98 of plate 96 for further transmission through, for example, another similar fiber optic coupler (not shown) to turbine 42 speed control equipment (not shown) which controls the supply of DRiVing air to fitting 96-2, thereby controlling the turbine 42 rotation rate.

BRaKing air to slow the turbine 42 rotation rate is supplied from fitting 40-5 through passageways 160 to a braking air nozzle 162 which directs braking air, when it is supplied to fitting 40-5 at braking air buckets formed in the rearwardly facing surface of rotor 58.

Exhaust air from the low pressure side 164 of turbine 42 is exhausted through passageways 40-6 and mufflers 106 into rear shroud 100. From shroud 100, the exhaust air is vented through the 1 EXHaust and 2 EXHaust ports in plate 96. In this way, the turbine 42 exhaust is conducted in a direction away from the area radially directly outwardly from slot 78 where the dispensed powder cloud is formed and sustained, rather than being exhausted in a direction generally toward the powder cloud.

The powder cloud is shaped by SHaPing air supplied through fitting 96-3, line 95, fitting 40-3 and passageways 81, 82 and 84.

Figure 23:
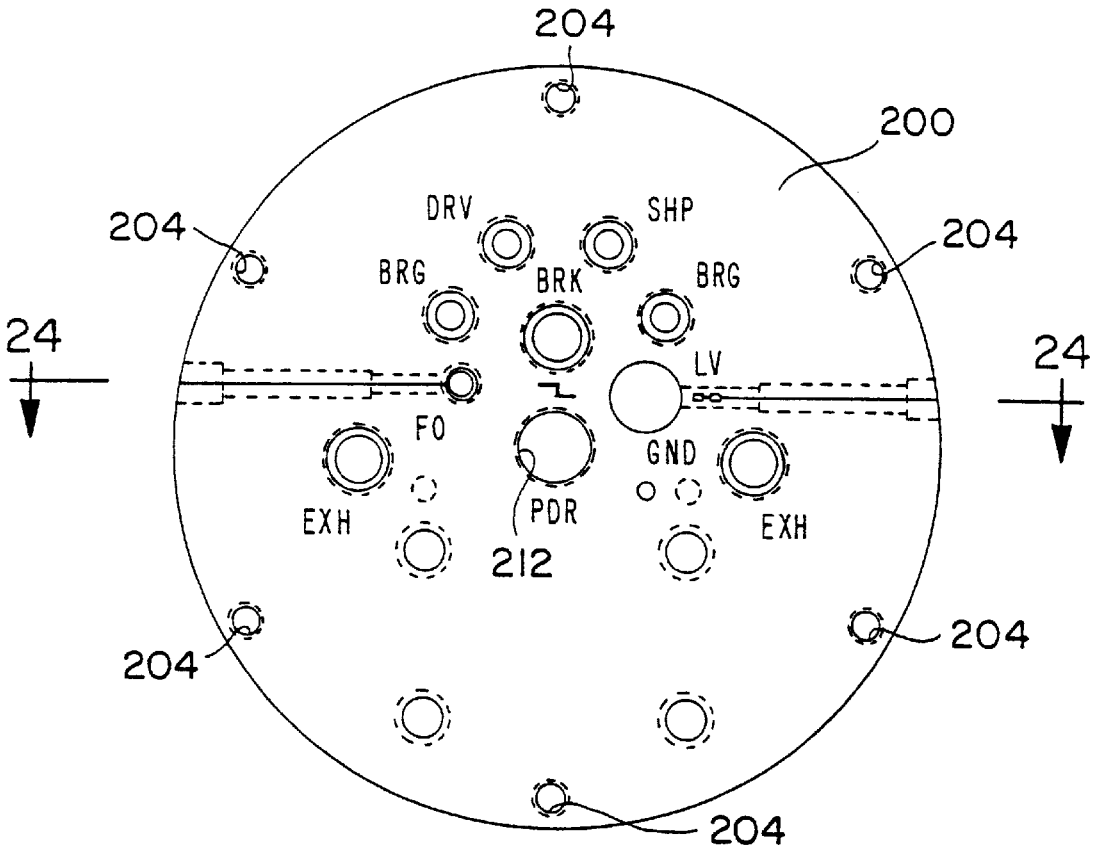
FIG. 23 illustrates an elevational view of a mounting plate for mounting the powder dispenser illustrated in FIG. 1; and, FIG. 24 illustrates a sectional view through the mounting plate illustrated in FIG. 23, taken generally along section lines 24—24 of FIG. 23.
Figure 24:
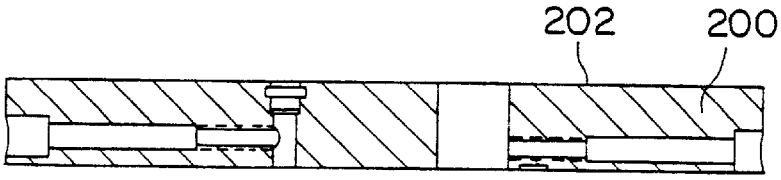

Referring now to FIGS. 23-24, a mating plate 200 has a flat forward surface 202 facing the rearward surface 98 of plate 96. Threaded openings 204 are circumferentially equally spaced around surface 202 for receiving cap screws 206 in flange 92. Tightening of cap screws 206 in openings 204 compresses the O-rings 99 between surfaces 98 and 202 around mating fluidized PowDeR, DRiVing air, SHaPing air, BeaRinG air 1 and 2, BRaKing air, FiberOptic and EXHaust air 1 and 2 openings in both of plates 96 and 200. This constructions effectively seals each of these passageways anytime the two plate 96, 200 are so secured to each other, and permits the quick and easy disconnection, reconnection and, if necessary or desirable, replacement of dispenser 38 with another dispenser of like or similar configuration.

Because the fluidized powder supplied to fitting 96-1 is somewhat penetrating, the configuration of the PowDeR fitting 96-1 of the quick disconnect 96, 200 is somewhat different. Specifically, fitting 96-1 includes a nipple 210 provided with an additional O-ring seal 99. The nipple 210 of fitting 96-1 slides into, and is sealed by this additional 0-ring 99 within, a relief 212 provided for the nipple 210 in surface 202 of plate 200. Plate 200 is mounted on any desired type of mounting, such as a stand, reciprocator, booth wall or the like, which presents powder bell cup assembly 60 at a suitable position adjacent articles to be coated by powder coating material to be dispensed therefrom.

What is claimed is:

1. A dispensing device for a coating material, the dispensing device including an outer portion including a first, inner surface, the outer portion having a central passageway for mounting the outer portion on a rotary shaft for rotating the dispensing device, and an inner portion having a second, outer surface shaped complementarily to the first surface and a somewhat bell- or cup-shaped third, inner surface, and means for retaining the inner portion in the outer portion with the first and second surfaces in engagement.

2. The apparatus of claim 1 wherein the outer portion is constructed from a first material having mechanical strength to withstand the stresses attending rotation of the dispensing device but being relatively less inert to the movement of coating material across it, and the inner portion is constructed from a second material relatively more inert to the movement of coating material across the third surface.

3. The apparatus of claim 1 wherein the first and second surfaces both extend to a circular discharge edge of the dispensing device.

4. The apparatus of claim 3 further comprising a third portion having a fourth surface cooperating with the circular discharge edge to define an annular discharge slot.

5. The apparatus of claim 4 wherein the third portion is constructed from the second material.

6. The apparatus of claim 1 wherein the second surface extends to a circular discharge edge of the dispensing device, the apparatus further comprising a third portion having a fourth surface cooperating with the third surface to define an annular discharge slot and the means for retaining the inner portion in the outer portion comprises means for retaining the third portion in spaced apart relation to the second portion to define the annular discharge slot.

* * * * *